United States Patent [19]

Fraser

[11] 4,017,983

[45] Apr. 19, 1977

[54] FREEZE DRYER

[75] Inventor: Douglas S. Fraser, New Paltz, N.Y.

[73] Assignee: FTS Systems Inc., Stone Ridge, N.Y.

[22] Filed: May 21, 1975

[21] Appl. No.: 579,679

[52] U.S. Cl. ..... 34/92; 34/5

[51] Int. Cl.[2] ..... F26B 13/30

[58] Field of Search ..... 34/5, 92

[56] References Cited

UNITED STATES PATENTS

| | | | |
|---|---|---|---|
| 2,573,290 | 10/1951 | Guilder | 34/92 X |
| 2,831,549 | 4/1958 | Alpert | 34/5 X |
| 2,859,534 | 11/1958 | Copson | 34/92 X |
| 3,293,773 | 12/1966 | Frazer et al. | 34/92 |
| 3,474,543 | 10/1969 | Bender et al. | 34/92 X |

*Primary Examiner*—John J. Camby

*Attorney, Agent, or Firm*—Robert E. Wagner; Robert E. Browne; Gerald T. Shekleton

[57] ABSTRACT

A freeze drying apparatus of the manifold type having a generally horizontal free standing condenser tube enclosed within a removable hollow manifold having a plurality of ports formed in it for communication with the interior of containers having specimens to be sublimated. The condenser tube is disposed generally along the central axis of the manifold so that the distance between the condensing surface and the manifold ports is relatively short and constant to provide fast and uniform sublimation. The condenser tube is packed with a woven copper mesh to provide increased surface area for wetting by the refrigerant fluid thereby increasing the condenser capacity and reducing its temperature. The location of the condenser tube within the manifold provides a single volume to be evacuated and speeds system recovery as new materials are added to the system.

14 Claims, 5 Drawing Figures

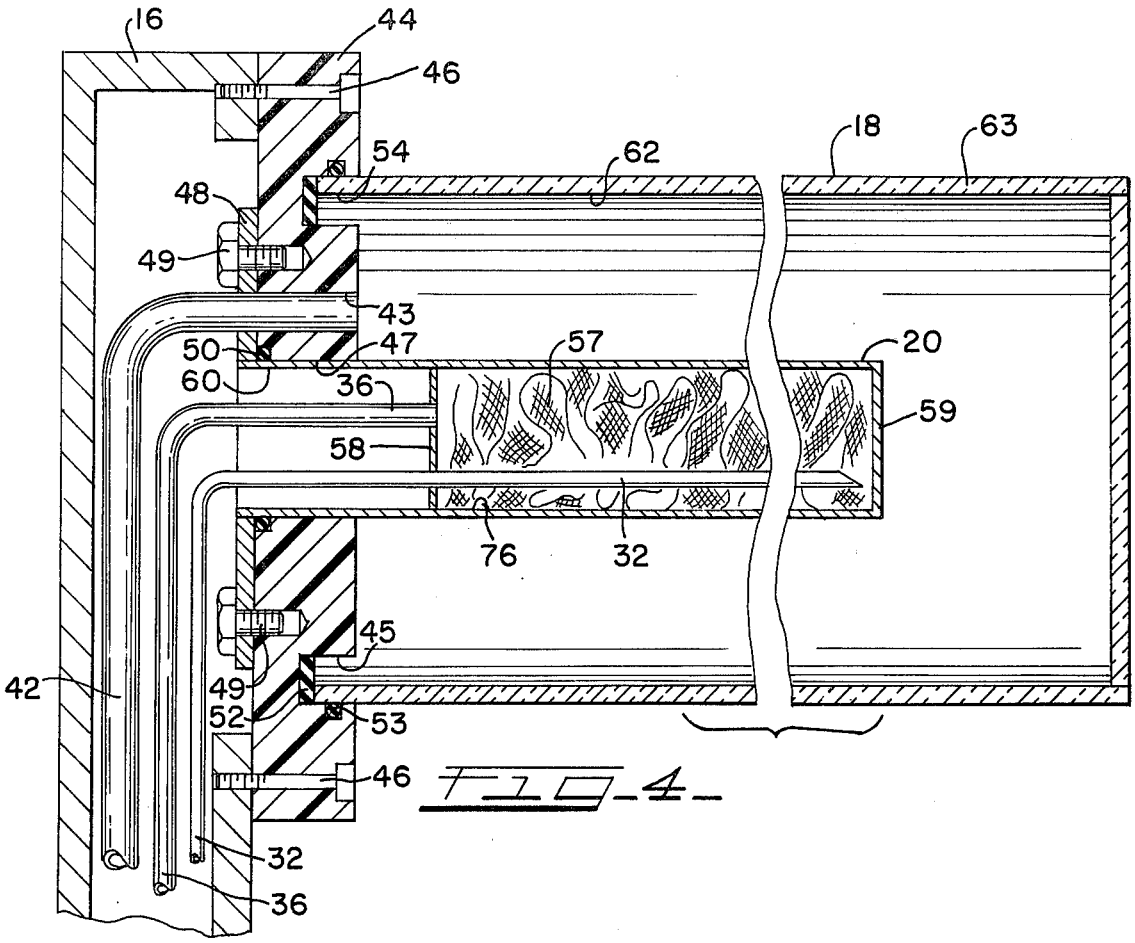
FIG-4-
FIG-5-
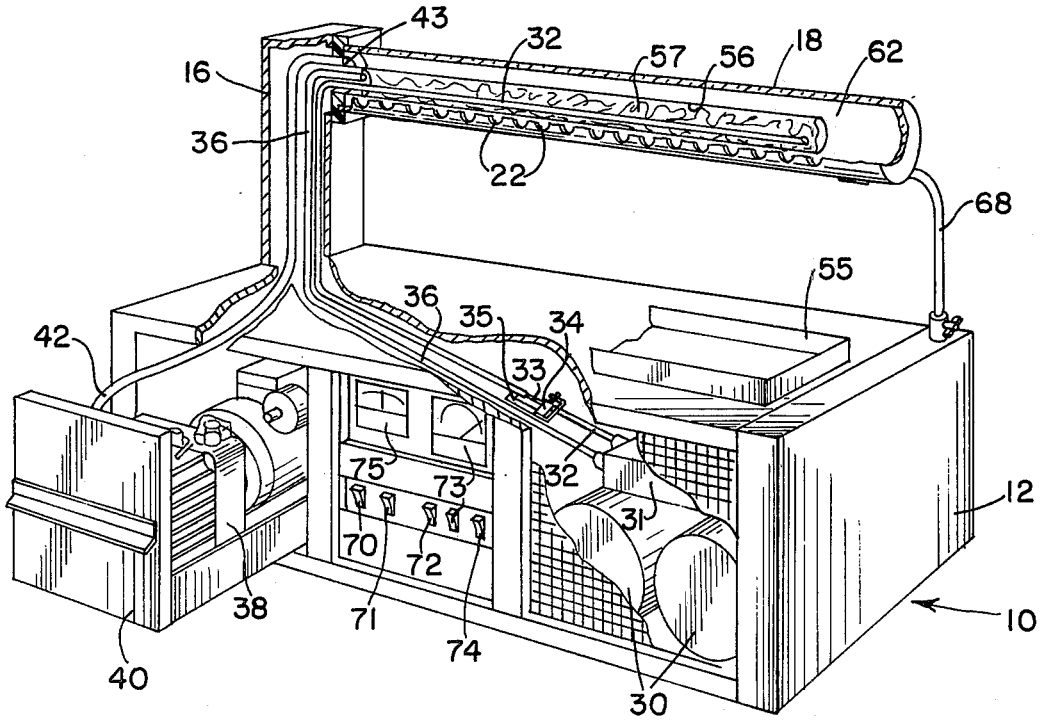

FREEZE DRYER

BACKGROUND OF THE INVENTION

This invention relates to freeze dryers in general and, in particular, to manifold-type freeze dryers.

Commercially available manifold-type freeze dryers enjoy heavy use in laboratory and research applications. These freeze dryers normally include a refrigeration systen having a refrigeration compressor, a condenser, a restrictor and an evaporator (freeze-drying condenser), and a vacuum system mounted in a base supporting a manifold tube having a series of ports and associated valves for receiving specimen containers. The manifold tube is in communication with the freeze drying condenser which is usually an enclosed metal container or vessel cooled by the refrigeration system. A vacuum is applied through the manifold tubing and the condenser by the vacuum system to sublimate the water vapor from the specimen through the entire manifold tube into the condenser.

These prior devices, because of their construction, were difficult to clean and disinfect. In addition, the location of the condenser apart from the manifold on which the specimen containers were mounted, increases the volume which the vacuum system must draw down and requires the water vapor to travel a long and tortuous path between the product and the condenser. These factors slow both cooling time and system recovery as further product containers are added to the manifold. Presently available freeze dryers of this type also have limited freeze drying capacity because of the inability of the condenser to handle heavy loads and maintain low temperatures without increasing the size and cost of the refrigeration system. Finally, the refrigeration and vacuum components in prior systems were often inaccessible and therefore, difficult to service and maintain.

SUMMARY OF THE INVENTION

The present invention overcomes the above problems inherent in the prior art by a unique concept and contstuction which increases the low temperature capability of the freeze drying condenser while reducing the volume of the freeze drying manifold and the distance which the water vapor must travel during the sublimation.

The present invention includes a base in which is mounted a vacuum pump and a refrigeration system including compressors, a condenser and a restictor. Mounted on the base containing these support systems is a hollow support post. A hollow, free-standng condenser tube is mounted on the support post. This tube is closed at its free end and in communication, through its opposite end, with the refrigeration system. The tube interior is packed with a woven, copper mesh which surrounds a capillary refrigerant supply line terminating near the closed end of the condenser tube.

Posited concentrically around the condenser tube, and having one end fluid tightly mounted on the support post, is a shell having a series of ports formed in it, which acts as a freeze drying manifold. Over each port is mounted a valve which is adapted to receive a container containing material to be freeze dried. The manifold volume is constant and in communication with the supporting vacuum system by a vacuum conduit. The concentric mounting of the manifold over the condenser tube assures that the distance between the condenser surface and each port along the length of the manifold is equal. Moreover, the distance between the condenser and product is very small in comparison to prior dryers. The frozen products will therefore, be rapidly subjected to low vacuum and uniform cold temperatures during freeze drying. Since the condenser is located only inches from each port and in a straight line from each product, the time rate of diffusion of water vapor will be optimum.

The relatively constant volume of the manifold provided by the location of the condenser tube physically within the manifold permits a much more rapid recovery by the system when additional containers are opened to the system than in prior dryers using a separate condenser and manifold. Moreover, the use of a woven copper mesh within the freeze drying condenser both enlarges the surface area of the refrigerant to be evaporated and distributes the refrigerant more uniformly throughout the condenser. This provides lower condenser temperature and much greater capacity.

When sublimation has been completed a hot gas defrost is available through the refrigeration system to the condenser tube. The manifold may be easily removed and the ice slipped off the condenser tube which can then be cleaned or disinfected. The vacuum pump is mounted in a drawer in a support base and pulls out for easy cleaning and maintenance.

Accordingly, it is an object of the present invention to provide a freeze drying apparatus and assembly of the manifold type.

It is a further object of the present invention to provide a freeze drying assembly which includes a horizontally disposed manifold surrounding a parallel, free-standing condenser tube maintained in constant spaced relationship to the ports formed in the manifold for communication with the products to be sublimated.

It is another object of the present invention to provide a freeze drying apparatus in which the freeze drying condenser is formed by a hollow elongated tube packed with a woven mesh of a highly thermally-conductive material to thereby increase the low temperature capability and capacity of the condenser.

It is one more object of the present invention to provide a freeze drying apparatus in which the freeze drying condenser is generally located within and along the length of the manifold to shorten the distance between the product and the condensing surface and to reduce the manifold volume and thereby increase drying capacity and facilitate system recovery.

It is still another object of the present invention to provide a freeze drying apparatus in which the supporting vacuum system is mounted in a pull-out drawer in the base of the system for convenient servicing and maintenance, and the referigeration system may be used to defrost the condenser tube after freeze drying.

It is a still further object of the present invention to provide a freeze drying apparatus having an elognated hollow manifold which surrounds an elongated hollow condenser tube, the manifold being movable relative to the condenser to change the position of ports formed therein, and removable to facilitate deicing and cleaning of the condenser tube.

These and other objects of the present invention will become more apparent from the following description of the preferred embodiment, taken in conjunction with the drawings wherein.

Figure 1:
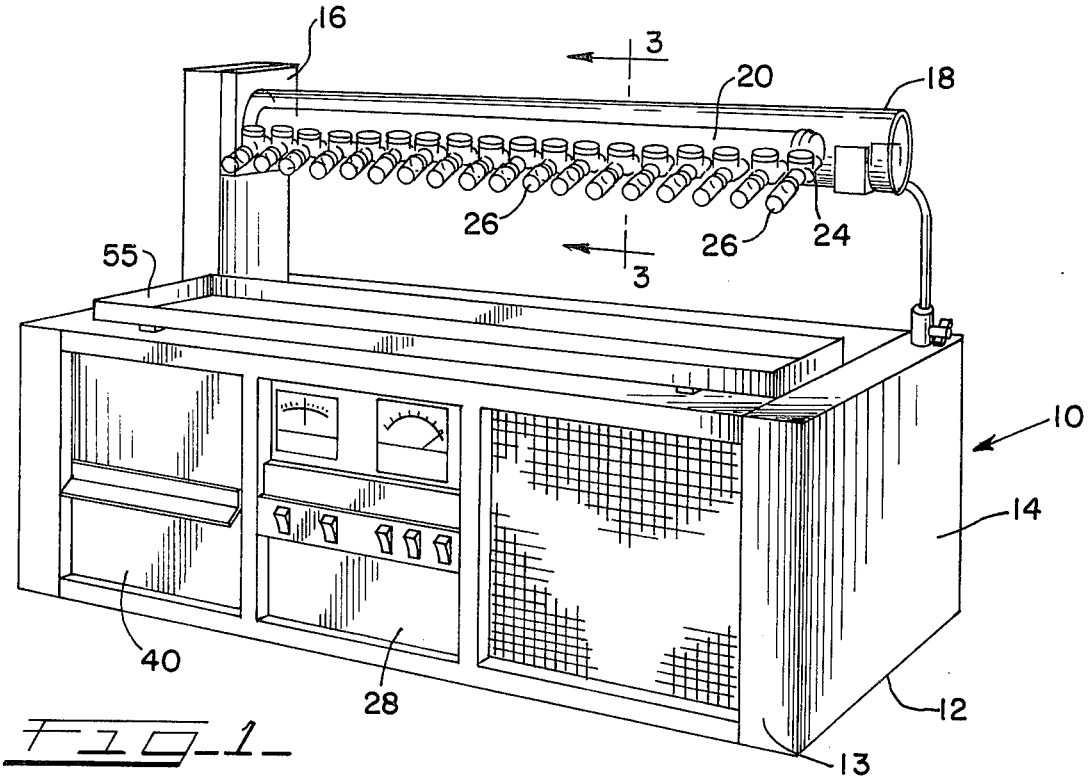
FIG. 1 is a perspective view of the freeze drying apparatus of the present invention, including the base containing the vacuum and refrigeration support systems.
Figure 2:
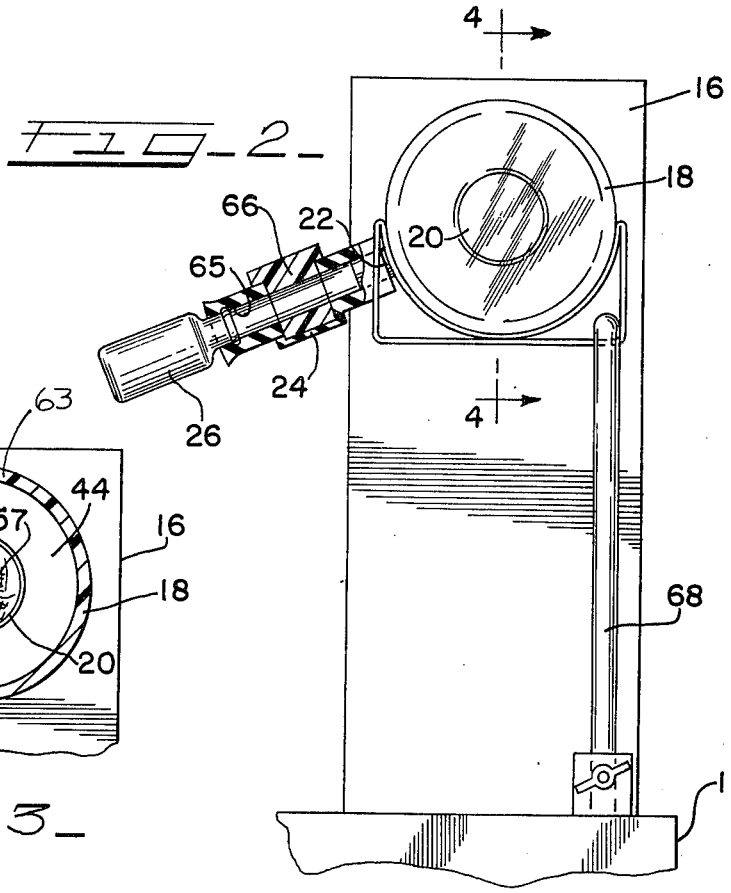
FIG. 2 is a right-hand elevational view of the support post and freeze drying manifold assembly of the apparatus shown in FIG. 1, also showing, in cross section, a typical valve communicating the manifold and the product containers.
Figure 3:
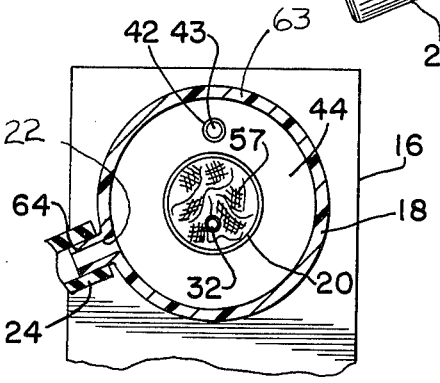
FIG. 3 is a cross-sectional elevational view of the manifold assembly of the freeze drying apparatus of the present invention, taken generally along line 3—3 in FIG. 1.

FIG. 4 is a slightly enlarged, cross-sectional front elevational view of the freeze drying manifold assembly and support post of the present invention, taken generally along 4—4 in FIG. 2; and FIG. 5 is a perspective view of the freeze drying apparatus of FIG. 1, showing in partial cut away, the manifold assembly of the present invention and the connection thereof to the refrigeration and vacuum support systems contained in the base of the apparatus.

DESCRIPTION OF THE PREFERRED EMBODIMENT

Referring now to the drawings and, in particular, to FIG. 1, the freeze drying apparatus of the present invention is shown, in generally, at 10. This apparatus 10 includes a supporting base 12, which includes a fromt 13, opposite sides 14 and a back, which is not shown. Base 12 contains the vacuum and refrigeration support systems and the controls for the apparatus, as will be explained in detail below.

On one side of the top of base 12, as shown in FIG. 1, is mounted a generally vertical, hollow support post, 16, whose function is to support a freeze drying manifold assembly including a manifold 18, and a condenser tube 20, in horizontal position generally parallel to the top surface of the support base 12. Manifold 18 has a plurality of ports 22, preferably formed in a spaced linear relationship, along its length. A corresponding number of vacuum valves 24 are mounted over ports 22, for connecting specimen containers 26 to the manifold. Valves 24 may be operated to communicate the interior of each specimen container to the interior of the manifold. A control panel 28 is mounted in the center of the support base to regulate the operation of the apparatus 10.

The refrigeration means or support system, as shown in FIGS. 4 and 5, may include cascade hermetic 1/2 horsepower four pole compressors 30 using a freon refrigerant permitting rapid cool-down and heavy loading on the refrigeration condenser 31. The refrigerant flows from the compressers 30, through the condenser 31, through a refrigerant supply line 32 and capillary restrictor 33, toward manifold 18 which contains the freeze drying condenser 20 functioning as the evaporator in the refrigeration system. A solenoid 34 and restrictor bypass line 35 are used in defrosting the condenser 20, as will be explained below. A slightly larger diameter suction line 36 returns the evaporated refrigerant to the compressor for recirculation.

Support base 12 also includes a vacuum pump 38, which is preferably of the direct drive type, which is in communication with the interior 62 of manifold 18 by a vacuum conduit 42 made of stainless steel, having an orifice 43 near the proximal end of manifold 18, as is shown in FIG. 5. The vacuum orifice 43 is sized to receive a standard plug which, because of the location of the orifice in the manifold, permits testing of the vacuum system up to the manifold. Vacuum pump 38 is mounted in a pull-out drawer 40 in the support base 12 to provide easy access for oiling and servicing.

The mounting of the manifold 18 and condenser tube 20 on the freeze drying apparatus 10 represents a significant advance over the prior art because it permits easy removal of the manifold to facilitate removal of ice from the condenser and allows decontamination of the manifold and condenser. The support post 16 is hollow to allow the vacuum conduit 42, refrigeration supply line 32 and suction line 36 to extend upwardly through it to the condenser and manifold. One side of the generally rectangular support post 16 is covered by a specially designed mounting plate 44 formed from a block of material sold under the trademark "DELRIN", or any suitable material which is temperature resistant and resistant to the acids and other corrosive materials commonly encountered in various freeze drying applications today. Mounting plate 44 has a generally circular mounting ring 45 formed in its outward face to receive manifold 18. It also has a central mounting bore 47 formed through it to receive the inward or proximal end of condenser tube 20. Mounting plate 44 is attached to support post 16 by means of mounting bolts 46.

The condenser 20 is a generally cylindrical hollow tube, preferably formed of a material such as stainless steel because of its corrosion resistance, workability and moderate cost. While it would be preferable if the condenser could be formed entirely of copper, or be a solid copper rod, the cost of such a material is prohibitive. The condenser tube 20 if formed with an open or proximal end 60 and a closed, or distal, end, 59, as shown in FIGS. 4 and 5. The proximal end 60 is inserted through the mounting bore 47 in mounting plate 44 and extending a slight distance through the plate so that the inward edge of end 60 of the condenser 20 may be clamped in place by a back plate 48 attached to mounting plate 44 by back plate bolts 49. This securely fixes the condenser tube 20 in a free-standing position generally horizontal to the top of base 12. A back plate "O " ring 50 is sandwiched between the condenser tube, the back plate and the mounting plate, as shown in FIG. 4 to fluid-tightly seal their junction. The manifold 18 which is open at one end 54 and closed at its opposite end, may then be inserted over the condenser tube 20 by inserting its open end 54 into the mounting ring 45 on mounting plate 44. A rubber end seal 52 and an "O" ring manifold seal 53, located as shown in FIG. 4, function to fluid-tightly seal the end of the manifold to the mounting plate to prevent the escape of any vaporized materials and to maintain the vacuum within the volume defined by the manifold and the mounting plate, which serves as a closure means for the open end of the manifold. This method of mounting also pemits the manifold to be rotated relative to post 16 to position the ports 22 at any desired angle.

The condenser tube 20 is mounted generally along the central axis of the manifold 18, i.e., the manifold and condenser are concentrically mounted. As shown in FIGS. 4 and 5, this permits the distance between the condensing surface of the condenser 20 and the ports 22 formed in the manifold 18 to be equal and constant along the entire length of the manifold. The manifold has a larger outer diameter than the condenser so that the interior volume of the manifold minus the volume of the condenser becomes the sole volume to be evacuated in the freeze drying apparatus. These features differ from prior art designs in which the condenser was completely separate from the manifold volume and the ports on the manifold were at varying and often substantial distances from the condenser. The constant and equal distance between the port and the condensing surface in this invention assures that the specimens contained in the containers along the manifold will be uniformly exposed to the condenser temperature, and the water vapor diffusing from the specimen to the condenser will travel the same short distance for all specimens, thereby reducing and better controlling drying times. The distance between the condensing surface and each port is generally on the order of two inches which is signficantly less than in most prior art designs.

Another distinct advantage of this freeze drying apparatus is that the entire volume which must be evacuated by the vacuum system is defined within the interior 62 of manifold 18 and is signficantly reduced fron prior art volumes in which a separate condenser volume and a separate manifold volume had to be evacuated by the vacuum system during a freeze drying operation. While specimens are often added to the system one by one or in small groups to reduce the shock load on the refrigeration system, as each new container bearing a specimen is added, the system has to be restabilized to recover the desired temperature and pressue. Since there is only a single volume here, it will take less time for the vacuum pump to pull down this single, smaller volume system than to pull down a system having separated condenser and manifold volumes. In addition, vacuum conductance, or flow of molecules at low pressures is subject to the random motion of such molecules, and a system having separate manifold and condenser volumes presents many obstacles to the withdrawal of such molecules thereby preventing the system from stabilizing rapidly or "recovering". In this invention, however, the extremely short distance between the condenser and the ports, and the single manifold volume having the vacuum port 43 located directly in communication with it without obstacles, facilitate a much more rapid vacuum pull-down and promotes excellent recovery times when new containers are added. The possibility of contamination is also reduced since no inaccessible crevices are present to collect contaminants.

The construction of the condenser tube 20 itself also provides several advantages over the prior art. Condenser tube 20 is hollow and elongated and has a baffle 58 located near its proximal or inward end 60 to support the supply line 32 and suction line 36 from the refrigeration means to prevent the escape of refrigerant fluid. Supply line 32 extends into condenser tube 20, terminating near its distal end 59. Between end 59 and the baffle 58 the tube 20 is packed with a woven copper mesh 57 or any other suitable highly thermally conductive material having a large number of wetting surfaces. Mesh 57, being formed from copper, is highly thermally conductive and also provides a tremendous number of thermal conducting surfaces within the stainless steel condensing tube 20. Mesh 57, therefore, enlarges the surface area of the refrigerant fluid which is to be evaporated. At the same time it also acts as a wick to conduct this refrigerant fluid throughout the condensr tube and toward the surface of the condenser tube 20 to create a uniform temperature throughout the condenser tube. This construction achieves the advantages of optimum cooling temperatures within the condenser of a freeze dryer which would normally only be possible by either flooding a hollow condenser or using a solid copper rod. Solid copper is too costly and flooding would require either a refrigeration system of tremendously larger capacity and cost or would tend to overload and damage smaller systems.

The flow of the refrigerant fluid originates from the end 59 of the condenser tube and moves toward suction line 36 to further promote a uniform temperature through the condenser and thereby presents a uniform temperature to the specimens through each port formed in the manifold. As the condenser becomes colder, the compressor begins to pump a part liquid, part vapor phase form of refrigerant. Without the wire mesh, the liquid refrigerant would tend to stand or puddle in the bottom portion of the condenser tube, presenting only a minimal surface area to be evaporated during sublimation of the product as in present condensers. However, in this invention, the refrigerant will be distributed over the mesh surface through the capillary action and its thermal conductance to thereby expand the area available for thermal energy transfer by evaporation of fluid and allow more refrigerant to be contained within the condenser. This will actually produce a colder temperature at the condenser than the nominal temperature of the refrigerant fluid being supplied by the refrigeration system, and will promote more rapid sublimation of the product ice and continued drying despite the formation of ice on the condenser surface.

The condenser tube is approximately three feet long and 1-½ inches in diameter and capable of condensing approximately 4-½ liters of water. Because of the low and uniform temeperature capability, the condensing surface actually increases as the ice loading increases on the condenser surface. The manifold preferably has a four inch outside diameter and is approximately 40 inches long. Any number of ports may be formed in it, usually linearly arranged and if desired, in parallel rows. The manifold may be formed of LUCITE or similar suitable material which is resistant to corrosion and permits completely visibility of the condenser surface. A stainless steel manifold having a LUCITE end plate for visibility could also be used. Each port 22 in the manifold is preferably provided with a mounting lip 64 formed in a wall 63 of the manifold of which a vacuum valve 24 as set forth in Ser. No. 568,981, filed Apr. 17, 1975, by Douglas S. Fraser, and titled "Valve Particularly Adapted for Use in Vacuum Work", may be mounted. These valves are open at both ends and have a valve passageway 65 formed through a flexible neoprene valve body. One end of the valve is mounted over lip 64 and the other end molded to fit flasks, ampules, serum bottle necks or conduits to various accessories. A polypropelene valve member or plug 66 is movable within the body to an open position which provides a restriction-free ½ inch opening between the freeze drying container 26 and the condenser tube 20.

In the operation of the freeze drying apparatus of the present invention, refrigeration switch 70 and vacuum pump switch 72 are thrown to initially start the refrigeration system and the vacuum system to cool the condenser and evacuate the interior 62 of the manifold 18. The frozen product is then mounted on the vacuum valve 24 which is opened so that the product is rapidly subjected to the low vacuum. Sublimation occurs due to the vapor pressure differential between the product ice and the condenser. For example, the vapor pressure difference between a product 20° C and a condenser at −60° C is about 762 millitorr. Water vapor will, therefore, diffuse from the product to the lower pressure area at the surface of condenser 20. Since the rate of diffusion or drying depends on the resistance encountered by the flow of water vapor, the rate in the present invention is extremely rapid since the condenser is located only 2 inches from each drying port 22 and valve 24 has a full opening with no bends or restrictions. The unique design of the condenser provides a sufficiently low temperature to remove the heat of sublimation from the condensing vapor and still maintain a low temperature condenser. All ports are located exactly the same distance from the condenser to provide uniform conditions for all product containers.

When the samples have been freeze dried, refrigeration switch 70 and vacuum switch 72 are switched off and a defrost switch 71 pressed. This actuates a solenoid valve 34 closing the restrictor 33 and moving refrigerant fluid through a bypass conduit 35 having a diameter similar to supply line 32. Without a restriction or expansion valve compressors 30 will supply hot discharge gas to the interior 66 of the condenser 20 to deice the condenser. Manifold 18 may be removed and the ice slipped off the condenser tube 20 prior to the next drying run.

If contamination could be a problem, when the manifold is off the condenser tube may be quickly cleaned with a disinfectant. The vacuum pump oil and the pump 38 can be checked by pulling out the drawer 40 for full accessibility. A drip pan 55 is also provided under the manifold flask to eliminate the messy puddles resulting from the room moisture condensing on the containers and to catch the ice removed from the condenser tube.

The control panel 28 is provided with a vacuum gauge and switch 73 and a vacuum break switch 74 to bleed air into the manifold at the end of a cycle. The ultimate system system vacuum in the preferred embodiment is approximately 5 millitors (5 microns). When a 4.5 cfm vacuum pump is used, the system may be pumped to 50 millitorr in 2 minutes and 4 millitorr in 5 minutes. A continuous reading thermalcouple 75 is mounted on the control panel which is connected by temperature sensor 76 mounted on the interior of the condenser to monitor the condenser temperature.

An adjustable free end brace 68 is provided near the free end of manifold 18 to position the manifold during operation of the apparatus and elevate the free end during removal of ice so that the water will drip into the drip pan.

While the present invention has been described in relation to a preferred embodiment thereof, it will be apparent to those skilled in the art that the structural details are capable of wide variation without departing from the principles of the invention.

What is claimed is:

1. A freeze drying apparatus of the manifold type particularly adapted for quickly and efficiently dehydrating heat sensitive materials contained in a number of independent containers simultaneously, including elongated maniflod communication having a plurality of ports formed therein, each for commuication with one of said containers containing said material to be freeze dried, a refrigeration system, comprising a freeze drying condenser means and refrigeration means, being a self-contained system and fluid-tight for the prevention of the entrance of foreign fluids and the exit of refrigerant fluids, said freeze drying condenser means for subjecting said materials in said containers to extremely low temperatures during a freeze drying cycle, said condenser means being disposed within said manifold means and extending along the length of said manifold means, said condenser means being located within said mainifold means such that an exterior surface of said condenser means is positioned in relatively constant spaced relationship and minimal distance from each of said ports formed in said manifold means to provide rapid, uniform sublimation of the material contained in each of said containers in communication with said ports, vacuum means in communication with said manifold means for applying a vacuum throughout said manifold and said ports to said material contained in said containers during a freeze drying cycle, and said refrigeration means in communication with said condenser means to supply and circulate refrigerant fluid through said condenser to thereby maintain said condenser means at a low temperature during said freeze drying cycle.

2. The apparatus of claim 1 wherein said manifold means includes a generally cylindrical, hollow shell having a plurality of ports formed therein and spaced along the length thereof, each of said ports providing communication between the interior of said shell and the interior of a corresponding container connected to said port and containing the material to be freeze dried, and said condenser means includes a generally cylindrical elongated, hollow member located within said shell and extending along a central axis of said shell such that an exterior surface of said condenser is maintained a uniform distance from each of said ports formed in said shell.

3. The apparatus of claim 1 wherein said condenser means includes a hollow, elongated member having a plurality of randomly disposed heat transfer surfaces located within an interior thereof, said heat transfer surfaces being exposed to said refrigerant fluid and transferring thermal energy from said elongated member to said refrigerant fluid, said surfaces accepting said refrigerant fluid thereon and acting to uniformly distribute said refrigerant fluid throughout said condenser means to thereby increase the efficiency and capacity of said condenser means to retain refrigerant fluid and reduce the temperature of said condenser means.

4. The apparatus of claim 3 wherein said plurality of randomly disposed heat transfer surfaces includes woven mesh packing formed of thermally conductive material inserted within said hollow, elongated member forming said condenser means, and said refrigerant means includes a supply conduit extending into said hollow member and terminating near a distal end thereof to supply refrigerant fluid into an interior of said member, and a suction conduit terminating near a proximal end of said member to remove refrigerant fluid and vapor which has evaporated upon contact with the woven mesh packing in the interior of said member.

5. The apparatus of claim 1 wherein said manifold means includes a hollow, elongated shell open at one end thereof and removably mounted on a generally vertical support post such that said shell extends generally horizontally from said support post.

6. The apparatus of claim 5 wherein said open end of said horizontal hollow shell forming said manifold means is received and fluid tightly closed by a vertically disposed closure member mounted on said support post, said closure member maintaining said condenser means in a generally fixed position relative thereto for insertion into said hollow shell forming said manifold means, said manifold means being removable from said closure member to allow access to said condenser means to remove ice accumulating thereon after operation of said apparatus.

7. The apparatus of claim 6 wherein said manifold means is angularly movable about a central axis thereof, relative to said support post and said condenser means to allow said ports formed in said manifold means to be moved to a desired angular position.

8. The apparatus of claim 1 including a support base having a vertical support post mounted thereon and extending upwardly therefrom, said manifold means having one end thereof mounted on said support post such that said manifold means extends generally horizontally therefrom, a vacuum pump located in said base, said vacuum pump being in communication with the interior of said manifold means by vacuum conduit means extending through said support post, and opening into said manifold means mounted thereon, said vacuum pump disposed in an outwardly movable drawer positioned in said base to thereby provide access to said vacuum pump for servicing and repair thereof.

9. The apparatus of claim 1 including means to defrost said condenser means by supplying hot gas to the condenser means.

10. A freeze drying assembly including a generally cylindrical, elongated hollow manifold member, an elongated cylindrical freeze drying condenser having a lesser outside diameter than the outside diameter of said manifold member, said condenser being disposed within said manifold member generally along a central axis thereof, said freeze drying condenser providing for the circulation of a refrigerant fluid therewithin, said manifold member having a plurality of ports formed therein to provide communication between the interior of said manifold member and a number of containers containing material to be freeze dried which may be connected to various ones of said ports, as desired, the disposition of said condenser within said manifold member being such that the distance between said condenser and each of said ports is substantially similar.

11. The freeze drying assembly of claim 10 wherein said manifold member and said condenser are generally horizontally disposed.

12. The freeze drying apparatus of claim 10 wherein said condenser contains a plurality of surfaces disposed within the interior thereof which uniformly evaporate refrigerant fluid supplied to said condenser thereby uniformly chilling said condenser during the freeze drying of said materials to facilitate the transfer of thermal energy between vapor sublimated from said materials and said refrigerant fluid,

13. In a freeze drying apparatus of the manifold type particularly adapted for quickly and efficiently dehydrating heat-sensitive materials contained in a plurality of independent containers simultaneously and, including vacuum means for applying vacuum to said materials to be freeze dried during the operation of said apparatus, refrigeration means to provide refrigerant fluid of a temperature lower than the temperature of the material to be freeze dried, and manifold means having a plurality of ports formed therein to which said containers containing the material to be freeze dried may be connected, the improvement comprising an elongated, hollow freeaze drying condenser member disposed in fluid-tight contact with the interior of said manifold means and receiving low temperature refrigerant fluid from said refrigerator means, said condenser member including a plurality of randomly disposed heat transfer surfaces located within the interior thereof, and said heat transfer surfaces receiving refrigerant fluid from said refrigerant means thereon, and acting to conduct said refrigerant fluid uniformly throughout said condenser member to thereby increase the capacity of said condenser member to retain refrigerant fluid and to reduce the temperature of said condensr member to facilitate transfer of thermal energy from water vapor sublimated from said materials to said refrigerant fluid.

14. The improvement set forth in claim 13 wherein said condenser member is disposed within and generally along a central axis of said manifold means and that said condenser means is spaced a generally equal distance from each of said ports formed in said manifold means to promote uniform freeze drying of said materials in said containers connected to said ports.

* * * * *

UNITED STATES PATENT OFFICE
CERTIFICATE OF CORRECTION

PATENT NO. : 4,017,983
DATED : April 19, 1977
INVENTOR(S) : Douglas S. Fraser

It is certified that error appears in the above-identified patent and that said Letters Patent are hereby corrected as shown below:

Col. 7, line 62, "maniflod communication" should be -- manifold means --

Col. 7, line 63, "commuication" should be -- communication --

Col. 8, line 10, "mainifold" should be -- manifold --

Col. 10, line 28, "freeaze" should be -- freeze --

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*